US005765481A

United States Patent [19]

Tortora et al.

[11] Patent Number: 5,765,481

[45] Date of Patent: Jun. 16, 1998

[54] APPARATUS AND METHOD FOR WORKING ON A LENGTH OF WEB MATERIAL

[75] Inventors: William J. Tortora, Willington; Jessica Dworak, Cromwell, both of Conn.

[73] Assignee: Gerber Scientific Products, Inc., Manchester, Conn.

[21] Appl. No.: 814,964

[22] Filed: Mar. 11, 1997

[51] Int. Cl.[6] ..... B41M 1/14

[52] U.S. Cl. ..... 101/211; 101/181; 101/248; 101/227; 226/29; 226/44; 226/2; 226/111

[58] Field of Search ..... 101/211, 181, 101/485, 486, 490, 621, 226–227; 400/208, 616, 616.1, 616.2, 616.3, 120.01, 120.04; 395/108, 131; 347/172, 173, 179, 197, 215, 217; 226/6, 14, 27, 28, 33, 44, 29

[56] References Cited

U.S. PATENT DOCUMENTS

| | | | |
|---|---|---|---|
| 3,658,163 | 4/1972 | Sniderman | 400/616 |
| 4,177,730 | 12/1979 | Schriber et al. | 101/490 |
| 4,887,530 | 12/1989 | Sainio | 101/486 |
| 4,898,094 | 2/1990 | Doumoto et al. | 101/485 |
| 5,189,440 | 2/1993 | Takakuwa et al. | 101/490 |
| 5,196,864 | 3/1993 | Caine | 347/173 |
| 5,244,293 | 9/1993 | Ludger et al. | 400/616.3 |
| 5,247,314 | 9/1993 | Stephenson | 400/120.04 |
| 5,386,772 | 2/1995 | Tulle et al. | 101/248 |
| 5,483,893 | 1/1996 | Isaac et al. | 101/485 |
| 5,537,135 | 7/1996 | Hevenor et al. | 400/208 |
| 5,551,786 | 9/1996 | Webster et al. | 400/616.3 |

*Primary Examiner*—Eugene H. Eickholt
*Attorney, Agent, or Firm*—McCormick, Paulding & Huber

[57] ABSTRACT

A length of web material is worked by a number of individual work units each of which performs a work function on the material to progressively achieve an end result, the work units being arranged serially along an X coordinate direction extending lengthwise of the web material and the web material being moved unidirectionally by each work unit. Accumulators are provided between adjacent ones of the work units and one or both of the work units located immediately on opposite sides of an accumulator are controlled in response to the amount of slack web material contained in the accumulator, as by stopping the feeding of the web material by the upstream one of the work units when the accumulated slack material exceeds a given amount and/or by stopping the feeding of the web material by the downstream one of the work units when the amount of accumulated material falls below a given amount. The work units may be a number of printers for printing end graphics onto the web material and a following cutting mechanism for cutting the end graphics from the web material. The end graphics may be multi-colored ones with each printer printing a color separate portion of the end graphics.

27 Claims, 6 Drawing Sheets

APPARATUS AND METHOD FOR WORKING ON A LENGTH OF WEB MATERIAL

FIELD OF THE INVENTION

This invention relates to the working of a length of web material by a number of individual work units to which the web material is brought in succession to progressively achieve an end result a portion of which end result is contributed by each unit, and deals more particularly with apparatuses and methods for efficiently performing such working.

BACKGROUND OF THE INVENTION

In the working of web material, it is well known and often necessary, when an end result of some complexity is desired to break up the working into a number of separate tasks and to perform each of those tasks by a separate machine or other work unit, and to then move the length of web material from one unit to another so as to be worked on progressively by the individual units. It is also known, when circumstances permit, to perform two or more of the tasks on the same work unit with the web material repeatedly being run through a single work unit and with that work unit being suitably modified between each run so that the two or more different tasks are performed by the one unit during separate different runs of the web material through it. The moving of the web material from one work unit to another and/or the repeated running of the web material through a single unit and the modification of that unit between runs has, in the past, given rise to problems in the handling of the web material and in the scheduling of the operations of the various work units.

The general object of this invention is, therefore, to provide apparatuses and methods for more efficiently performing the working of web material in situations where the end result is achieved by performing different tasks on a given portion of the sheet material at different times, and particularly in cases using a number of individual work units each performing a separate portion of the complete finished work.

The invention has particular utility in the field where the working of the web material concerns the printing of graphics onto the web material, and the possible cutting of the graphics from the web material, to produce finished graphic items for use as labels, signs, decorations, ornaments, appliques or the like. The invention is, therefore, hereinafter described as embodied in preferred apparatuses and methods for such printing of graphics onto the web material, and for the possible cutting of the graphics from the web material. There is no intention, however, to limit the invention to such field and instead it should be understood that the invention extends to other applications where the work units and method steps may involve work procedures other than printing and cutting of the web material.

In the field of printing and cutting web material, it is known, for example from U.S. Pat. No. 5,537,135 and U.S. Pat. No. 5,551,786, to print graphics onto lengths of receiving web material using a thermal printer wherein the web of receiving material is moved in a feed direction, extending longitudinally of the web material, past a thermal print head having a row of thermal printing elements arranged along a line extending perpendicularly to the feed direction, with a donor foil carrying a thermally releasable printing agent moving with the receiving web, and positioned between the thermal print head and the receiving web, so that energizations of the print head printing elements in response to image data provided by an associated controller cause transfers of corresponding spots (pixels) of the colored printing agent from the donor foil onto the receiving web. It is also known from U.S. Pat. No. 5,537,135 to cut the finished graphics from the receiving web to separate them into individual labels, signs, decorations, ornaments, appliqués or the like.

In these latter apparatuses and methods, the thermal printer works with a donor foil of only one uniform color as the receiving web material makes one pass in one direction through the printer. If multi-colored graphics are desired, it is necessary to print each color during a separate pass through the printer using differently colored donor foils for the different passes. That is, the web material is first fed through the printer in association with a first donor foil of a first given color and a first color separate portion, having the color of the first donor foil of the end graphics is printed onto the receiving web. The receiving web is then moved in the reverse direction though the printer, or is otherwise manipulated, to allow it to be moved again in the forward direction through the printer, and the first donor foil is exchanged for a second one having a second color different from the first color. The receiving web, along with the second donor foil, is then moved forwardly in a second pass through the printer and a second color separate portion, having the color of the second donor foil of the end graphics, is printed onto the web material. This process of returning the receiving web material to its starting position, exchanging the donor foil for one of a different color, and then running the web in a new pass through the printer is repeated until all of the required color separate portions of the end graphics have been printed onto the web material, and the finished end graphics are then, if desired, cut from the web material.

In keeping with the above-mentioned U.S. patents, the differently colored donor foils used to generate multi-colored graphics may be contained in cassettes and the utilized thermal printer may be one in which such a donor foil cassette can be exchanged for another one relatively easily. Nevertheless, whether the differently colored donor foils are provided by way of cassettes or not, the need to manipulate the receiving web so as to move repeatedly in several runs through the same printer and the need for changing donor foils between successive runs is tedious and time-consuming.

In the printing of graphics onto web material using printers such as described in U.S. Pat. No. 5,537,135 and U.S. Pat. No. 5,551,786, it is known to feed the web material through a printer at different speeds in dependence on the printing requirements of a given lengthwise section of the web material as it passes the print head of the printer. For example, in proceeding along the length of the given section of the web, there may be some portions of significant length throughout which no printing is required. Throughout the passage of those portions of the section which do require printing past the print head, the associated controller controls the feed of the web material so that the web moves at a relatively low speed. When a portion of considerable length requiring no printing reaches the print head, the controller may instruct the printer to lift the print head from the web material and to feed the web material at a faster speed until reaching a new portion of the section requiring printing. During the time the print head is lifted from the web material, the donor foil is also lifted from the web material and forward movement of it is stopped to achieve a conservation of the foil. Immediately before the next portion requiring printing reaches the print head, the print head and donor foil are again lowered onto the web material and the speed of feed is again lowered to the lower value used for printing.

Therefore, in the case of serially arranged printers each printing different parts of an end graphic onto a given seciton of the web material the given section of the web material may have differing amounts of lengthwise portions not requiring printing for each printer, and the amount of time required by each printer for printing onto such given section of the web material may vary considerably from printer to printer and may cause problems in any attempt to deliver the web material directly from one printer to the next.

The invention, therefore, as specifically applied to the field of printing onto web material or the field of printing onto and cutting web material, has as its object the provision of an apparatus and method permitting the printing or the printing and the cutting to be accomplished in an efficient way and particularly without the need for having to repeatedly return the receiving web material to a given starting position and without the need for having to repeatedly change the donor foil used with the printer.

A further specific object of the invention in the field of printing onto or printing onto and cutting web material is to provide such apparatuses and methods which efficiently accommodate the fact that the individual printers or cutters may take different amounts of time in performing their work on a given length of the web material.

Other objects and advantages of the invention will be apparent from the following detailed description of a preferred embodiment of the inventive apparatus and method.

SUMMARY OF THE INVENTION

The invention resides in apparatuses and methods for working on a length of web material through the use of a number of separate work units or work procedures wherein the length of web material is successively moved from one work unit or work procedure to another to progressively achieve a composite end result made up of the portions of the work performed by the separate individual work units or procedures, and wherein the web material is moved in a feed direction serially through the work units which are arranged in series relation to one another along the feed direction.

The invention further resides in controlling each of the individual work units to perform a desired work function on the web material and to consume a given amount of time in feeding a given length of the web material through each unit which amount of time may be different for different ones of said units, and providing for the accumulation of a variable amount of slack material between at least one adjacent pair of said units and for controlling the web material feeding function of one or both of those work units in response to the amount of slack accumulated between the work units so as to achieve an efficient flow of the web materials through the entire apparatus.

The invention also resides in a printing apparatus, and related method, for producing graphics on a length of receiving web material and possibly for also cutting the finished end graphics from the web material to separate them into individual labels, signs, decorations, ornaments, appliques or the like, wherein a plurality of thermal printers are arranged serially of one another along a line extending in a feed direction for the web material. Each printer has its own feed mechanism for feeding the web past a print head forming part of the printer, and the leading portion of the receiving web material is fed successively into the next downstream one of the printers as it emerges from an upstream printer so that the web eventually moves in serial succession through the plurality of printers in the feed direction.

The invention, as described by the immediately preceding paragraph, also more particularly resides in each of the printers receiving and using for its printing operation a donor foil carrying a printing agent of a color different from that of the other donor foils so that each printer prints onto the receiving web a color-separate portion of the end graphics having the color of the donor web used by that printer and so that the end graphics are multi-colored ones.

The invention also resides in the apparatus and method including, if wanted, a cutting mechanism following the most downstream one of the printers for cutting the end graphics from the web material.

The invention also resides in still further details of the subject apparatus and method as set forth in the appended claims.

DETAILED DESCRIPTION OF THE PREFERRED EMBODIMENTS

Figure 1:
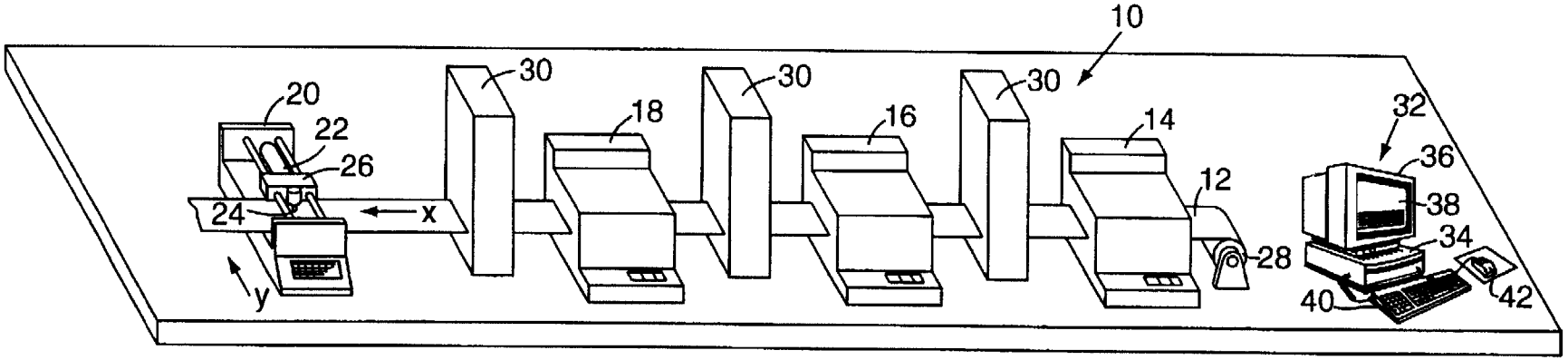
FIG. 1 is a perspective and somewhat schematic view of a thermal printing apparatus embodying the invention.
Figure 2:
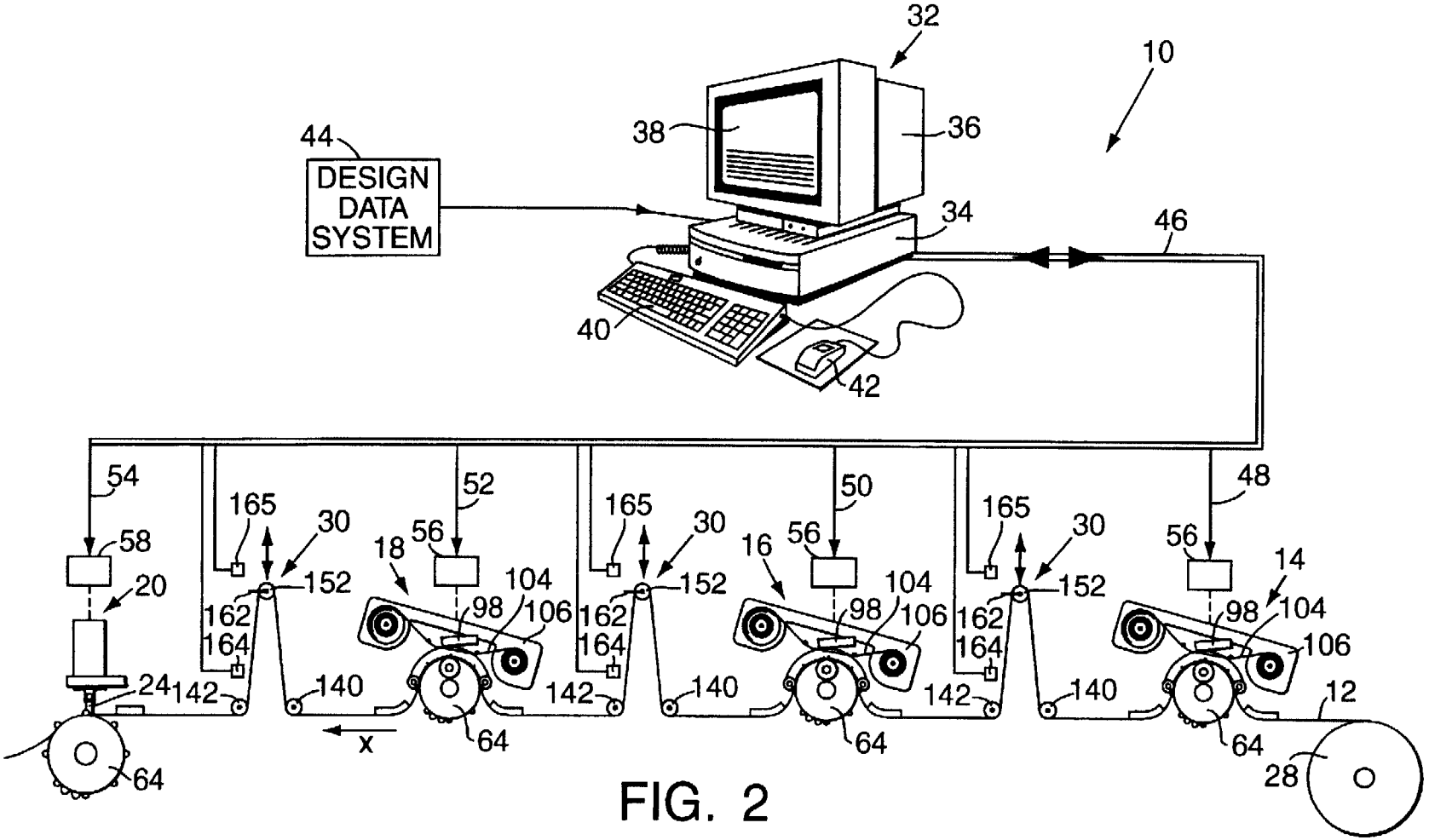
FIG. 2 is a more schematic view of the thermal printing apparatus shown in FIG. 1.

Turning first to FIGS. 1 and 2, these figures show an apparatus, indicated generally at 10 wherein four work units are provided for working on a length of web material 12 with the web material 12 moving progressively from one work unit to the other and with each work unit performing on the work material a separate portion of the end result. The nature of the various work units may vary in keeping with the broader aspects of the invention and in accordance with the desired complete work to be performed on the web material. In the illustrated case, however, the apparatus 10 is one for printing end graphics onto the web material 12 and for cutting such graphics from the web material, and the four work units are made up of three printers 14, 16 and 18 and one X-Y cutting mechanism 20. Again, these printers 14, 16 and 18 and cutting mechanism 20 may be of various different types well known in the art, but in the illustrated instance, all three of the printers 14, 16 and 18 are thermal printers such as described in the aforementioned U.S. patents, and the cutter 20 is one such as described by U.S. Pat. No. 4,467,525 and No. 4,591,999 wherein for its cutting the web material 12 is supported on a roller platen 22 and is cut by a knife 24 supported on a carriage 26 movable in a Y coordinate direction, the roller platen 22 moving the web material in the X coordinate direction longitudinally of itself so that the knife 26 is capable of cutting two-dimensional shapes from the web material by combined movements of the knife and web material relative to one another in the X and Y coordinate directions.

The graphics receiving web material is supplied from a supply roll 28 and is trained so as to move longitudinally of itself in the X coordinate direction serially through the three printers 14, 16, 18 and cutting mechanism 20 with the three printers and the cutting mechanism being arranged in spaced serial relationship to one another the X coordinate direction. The receiving web material may be any one of suitable commercially available materials and may, for example, be a single ply of such material as paper, plastic or synthetic paper or a laminate material made up of one or more plies of paper, plastic, synthetic paper and/or layers of adhesive and adhesive release coatings.

The apparatus 10 also includes three accumulators 30 arranged in line with the three printers and the cutting mechanism in the X coordinate direction and located as shown in FIGS. 1 and 2 between adjacent pairs of the printers and between the most downstream printer 18 and the cutting mechanism 20. As seen in FIG. 2 and as explained in more detail hereinafter, each accumulator 30 operates to accumulate a variable slack amount of the web material 12 and the operation of either one or both of the work units located immediately on opposite sides of the accumulator may be controlled in response to the amount of slack material momentarily accumulated in the accumulator to account for the fact that the individual work units may work on given lengths of the web material 12 in differing amounts of time.

The apparatus 10 also includes a control station, indicated generally at 32 having components for controlling the operation of the other components of the apparatus and providing an interface with a human operator through which the operator may enter various instructions and commands for starting and stopping parts of the apparatus, for making adjustments, and the like. In the illustrated case, the components at the work station include a computer 34 with an internal processor and memories, a monitor 36 with a display screen 38, a keyboard 40 and a mouse 42. The controller 34 receives image data from a design data system 44 for use by the three printers 14, 16 and 18 and by the cutter mechanism 20 in performing their individual printing and cutting functions. The design system 44 may be a CAD-System having a computer using a suitable CAD software program and one or more components such as a digitizer or a scanner for extracting image defining data from a prototype design or picture or for generating fresh designs with computer assistance. The software program used in the design data system 44 is preferably one available from Gerber Scientific Products, Inc., the assignee of this application, under the name GRAPHIX ADVANTAGE.

The computer 34 of the control station 10 stores the image data received from the design data system 44 and sends it as needed to the three printers 14, 16 and 18 and to the cutting mechanism 20. This image data is broken up into separate parts for each printer 14, 16 and 18 and the cutting mechanism 20 so that the image data sent to each printer and to the cutting mechanism 20 is only that required by each individual printer or cutting mechanism. The image data from the computer 34 is supplied to the work units over a cable 46 having a line 48 supplying the printer 14, a line 50 supplying the printer 16, a line 52 supplying the printer 18 and a line 54 supplying the cutting mechanism 20. In addition to the image data required by each work unit, the computer 34 also transmits to each unit instructions for controlling the operation of each unit.

As shown in FIG. 2, each printer 14, 16 and 18 includes a control unit 56 which receives the image data and instructions from the computer 34, and the cutter mechanism 20 includes a control unit 58 which receives the cutting data and instructions required by it from the computer 34.

Figure 3:
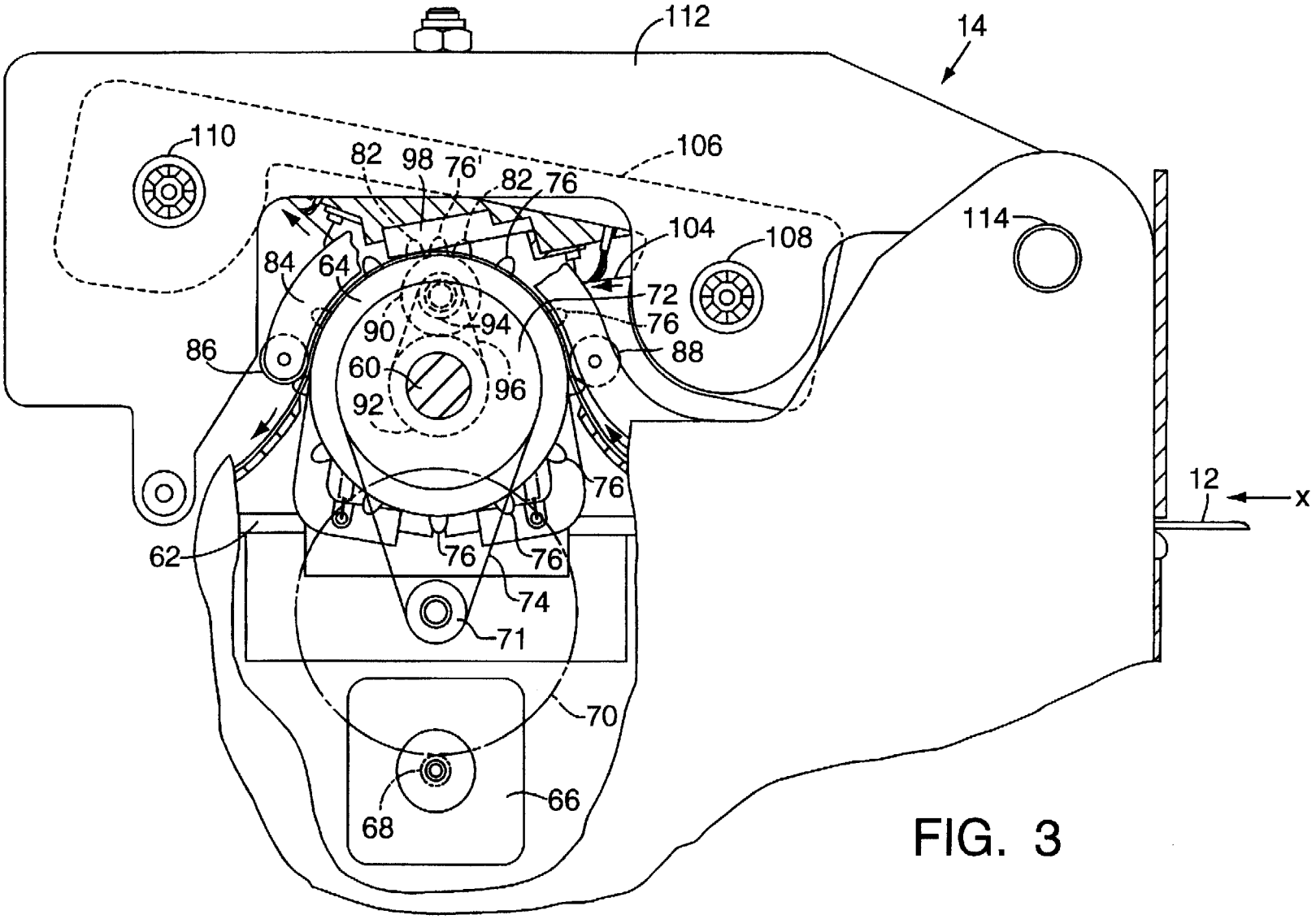
FIG. 3 is a fragmentary view, partially in side elevation and partly in vertical section, showing details of one of the printers of the FIG. 1 apparatus.
Figure 7:
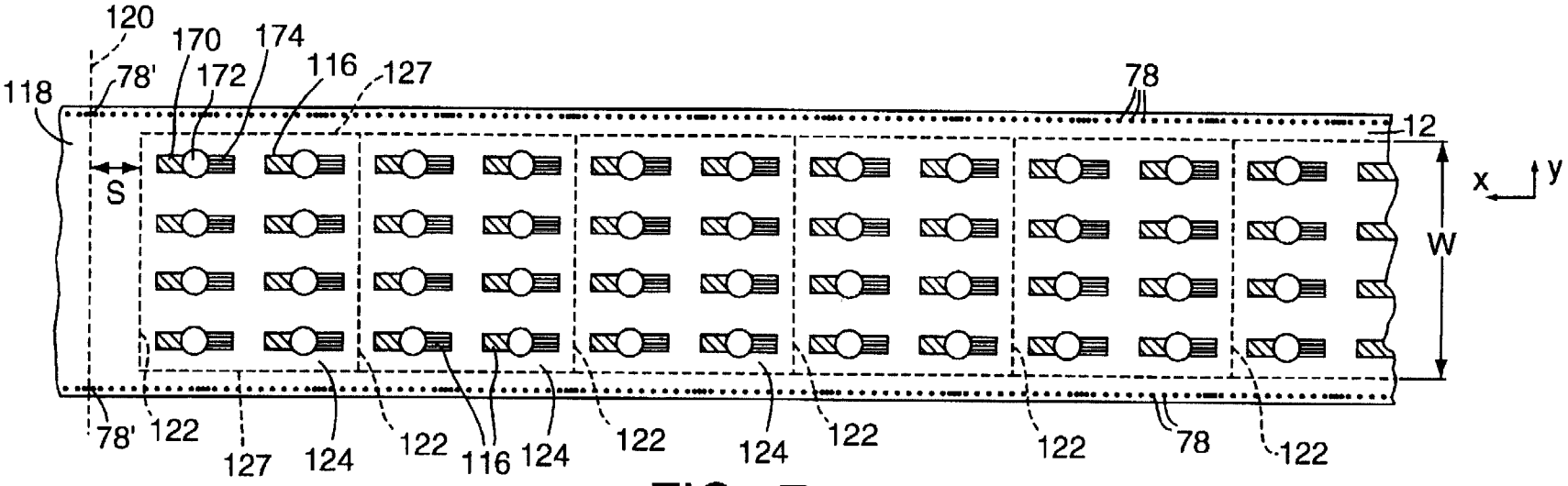
FIG. 7 is a plan view of the web material used with the apparatus of FIG. 1 and showing one example of end graphics printed onto the web material.
Figure 8:
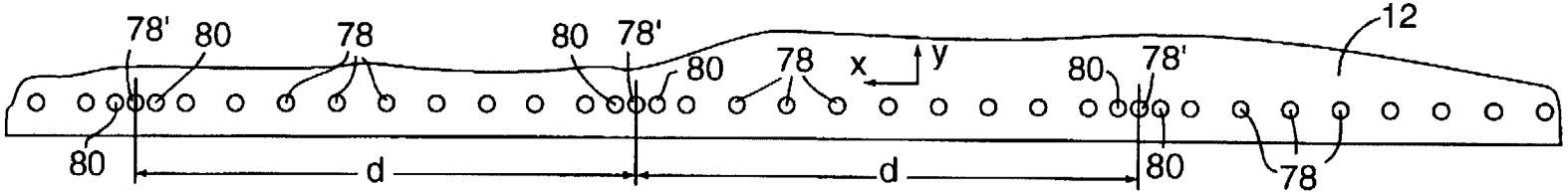
FIG. 8 is an enlarged fragmentary view of a portion of the web material of FIG. 7.

Turning to FIG. 3, this figure shows some of the details of each of the printers 14, 16 and 18 with the printer 14 being shown by way of example. Other details can be obtained from the above-mentioned U.S. Pat. No. 5,537,135 and No. 5,551,786. The printer 14 includes a feed mechanism for feeding the web material 12 in the X coordinate direction through the printer, which feed mechanism includes two drive sprocket wheels 64 fixed to a drive shaft 60 rotatably mounted within a base 62. Only one of the two drive sprocket wheels 64 is shown in FIG. 3, but they are essentially identical to one another and are spaced from one another by a distance of about 14½ inches along the length of the drive shaft 60. A drive motor 66 is mounted on the base 62 and drives the drive shaft 60 through a series of drive gears 68 and 70, two drive pulleys 70 and 72 and a toothed drive belt 74. Each of the two sprocket wheels 64 includes a set of ten sprocket pins 76 which engage a series of uniformly spaced feed holes 78 formed in each of the two marginal edge portions of the web 12 as shown in FIGS. 7 and 8 and thereby accurately position the web material both in the X and Y coordinate directions relative to the base 62 of the printer.

In the particular instance shown, the drive holes 78 in each marginal edge portion of the web 12 are spaced from one another by a uniform distance of one-half inch measured center to center. In order to provide position indicators along the length of the web 12, selected ones of the feed holes 78 are chosen to serve as such position indicators and are distinguished from the other feed holes 78 by two additional indicating holes 80, 80, as shown in FIG. 8 wherein each of the feed holes 78 serving as a position indicator is given the reference numeral 78'. In keeping with this, one of the sprocket pins on each sprocket wheel 64 is chosen as a position indicating pin. In FIG. 3, this position indicating pin is indicated by the reference numerals 76' and it is distinguished from the other of the sprocket pins 76 by two additional sprocket pins 82 located on either side of the position indicating pins 76' and arranged so as to be receivable in the holes 80, 80 of the web material 12.

To keep the web material engaged with the sprocket pins, a pair of liftable bail arms, one of which is shown at 84 in FIG. 3 rests respectively on each of the sprocket wheels at each end of the drive shaft 60 and supports hold down rollers 86 and 88 to keep the web material 12 engaged with approximately 180° of the sprocket wheel circumferences.

A roller platen 90 extends between the two sprocket wheels tangent to the cylindrical plane of the sprocket wheels at their uppermost points and supports the web material 12 in the space between the sprocket wheels. The platen is rotatably driven by pulleys 92 and 94 and a drive belt 96 trained about said pulleys 92 and 94. The platen is formed with an outer cylindrical surface made of hard rubber which acts as a friction drive surface engaging the bottom surface of the web material 12 and supporting the web material directly beneath a print head 98 extending along the length of the platen 90.

Figure 5:
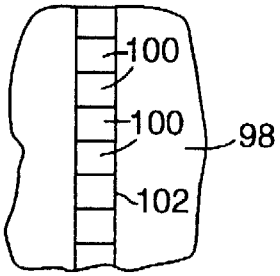
FIG. 5 is an enlarged fragmentary view of a portion of the print head as seen in FIG. 4.
Figure 4:
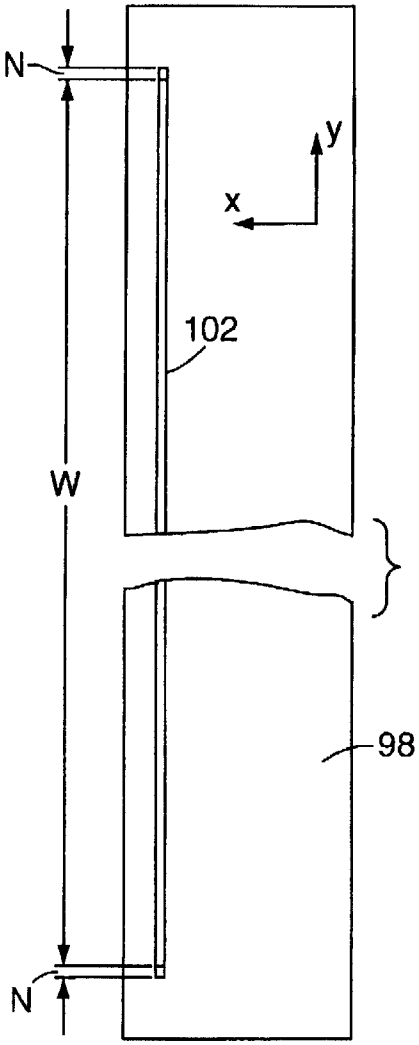
FIG. 4 is a bottom view of the print head of the FIG. 3 printer.

The print head 98 is a thermal print head having a total of 3,552 printing elements 100, as shown in FIGS. 4 and 5, arranged adjacent to one another in a row 102 extending along the length of the print head. The printing elements are of such size as to be packed at a density of 300 printing elements per inch along the row 102 making the row 102 11.84 inches long. Each printing element 100 is further of square shape as seen in FIG. 5 making its length in the Y coordinate direction equal to its length in the X coordinate direction.

To print images on the web material 12, the printer 14 uses a donor web 104 carried by a cassette 106 and having portions wound on spools 108 and 110 at opposite ends of the cassette. The cassette 106 and the print head 98 are both carried by a movable part 112 of the printer which is pivotally hinged to the base 62 of the printer by a hinge pin 114 allowing both the print head 98 and the donor foil 104 to be moved between the position shown in FIG. 3, whereat the donor foil 104 engages the web material 12 and moves with the web material in superimposed position with the web material 12 between the platen 90 and the print head 98, and a raised position at which both the print head 98 and donor foil 104 are removed from contact with the web material 12. When in this raised position, the donor foil is stationary. The donor foil 104 carries a thermally releasable printing agent which transfers from the donor foil to the top surface of the web material 12 as it passes beneath a heated one of the printing elements 100.

In the apparatus 10, the three printers 14, 16 and 18 are used to produce multi-colored end graphics on the web material 12 and it is taken by way of example that the end graphics are to be made up of portions of three different colors, namely the colors black, red and yellow. Further, each of the three printers is used to print a specific one of the color separate portions of the end graphics. That is, the printer 14 prints the black portions of the end graphics, the printer 16 prints the red portions of the end graphics and the printer 18 prints the yellow portion of the end graphics. To accommodate this, each of the three printers 14, 16 and 18 is used with a donor foil carrying a printing agent of the appropriate color, which means the cassette 106 used with the printer 114 carries a donor foil having a black colored printing agent, the cassette 106 used with the printer 16 carries a donor foil having a red colored printing agent and the cassette 106 used with the printer 18 carries a donor foil having a yellow colored printing agent.

FIG. 7 shows a portion of the web material 12 after it has passed through all three of the printers 14, 16 and 18 so as to contain end graphics 116 printed onto the web material by the combined operation of the three printers. It is necessary for the different parts of the end graphics to properly register with one another, and the procedure for achieving this is as follows. When introducing a length of sheet material into the apparatus 10 for the running of a given job, the feed mechanisms of all three printers 14, 16 and 18 are stopped, the print heads and donor foils are raised, and the sprocket wheels of all three printers are driven to their home positions, which can be achieved by entering a suitable command into the work station 32. Such home position is shown in FIG. 3 and is that position of each sprocket wheel at which its indicator sprocket pin 76' is at a top dead center position with respect to the axis of the drive shaft 60. The leading portion 118 of the web material is then placed onto the sprocket wheels of the first printer 14 so that a pair of indicator holes 78' of the web material are engaged with the two indicator pins 76' of the two sprocket wheels. This positioning of the web on the sprocket wheels establishes an imaginary home line 120 extending transversely of and fixed to the web material 12 which can be used as a reference line for measuring the positions of images in the X coordinate direction. The print head 98 and donor foil 104 are then brought to the active lowered positions shown in FIG. 3 and a start command is generated from the control station 32 to start the operation of the printer 14. As a result of this, the print head 98 of the printer 14 first becomes enabled after the web has been moved a preliminary distance S from the start position which defines the leading edge 122 of a first print frame 124 of the web 12.

Figure 11:
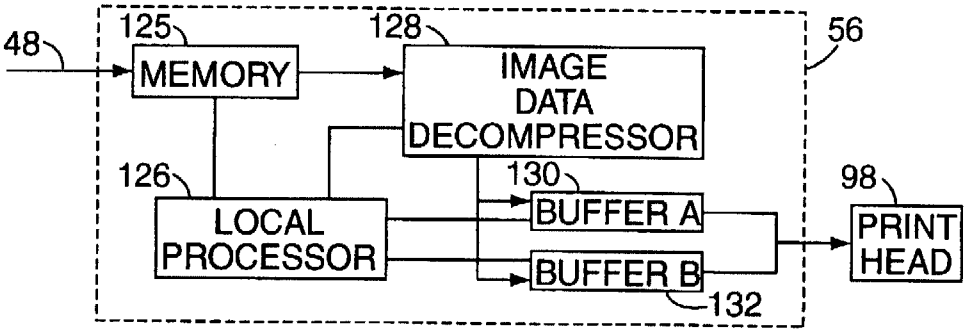
FIG. 11 is a block diagram showing components included in the control unit forming part of each of the three printers in the apparatus of FIG. 1.

Diverting to FIG. 11, the control unit 56 of each of the three printers includes a memory 124, a local processor 126, an image data decompressor 128 and two buffers 130 and 132 referred to as buffer A and buffer B, respectively. The image data provided to the control unit 56 on the line 48 from the computer 34 is supplied in compressed form and stored in the memory 124. Under control of the local processor 126, it is then, as needed, sent to the image data decompressor 128 for decompression and is then delivered in decompressed form to the buffers 130 and 132. The two buffers each store up to 3,600 lines of image data with each line of image data representing the data required to control the energizations of the printing elements 100 of the print head 98 for the printing of one line of information onto the web material. Further, the print head is operated in synchronism with the feed of the web material through the printer so as to print lines of information at a density of 300 lines per inch.

The two buffers 130 and 132 are used alternatively so that at any given time, one of the buffers is an active one used to supply lines of printing element energization data to the print head 98 while the other one of the buffers is a standby buffer being filled or already filled with new lines of data from the decompressor 128. When the last line of data in the active buffer is supplied to the print head 98, the next line of data for use by the print head is extracted immediately from the other buffer so that no gap appears in the image being printed on the web material because of the transitioning from one buffer to the other. The supplying of fresh line data to an emptied buffer occurs at a faster rate than the supplying of line data from the active buffer to the print head so that the stand-by buffer is always filled with line data and is ready for immediate use when the active buffer becomes completely emptied of line data.

Figure 9:
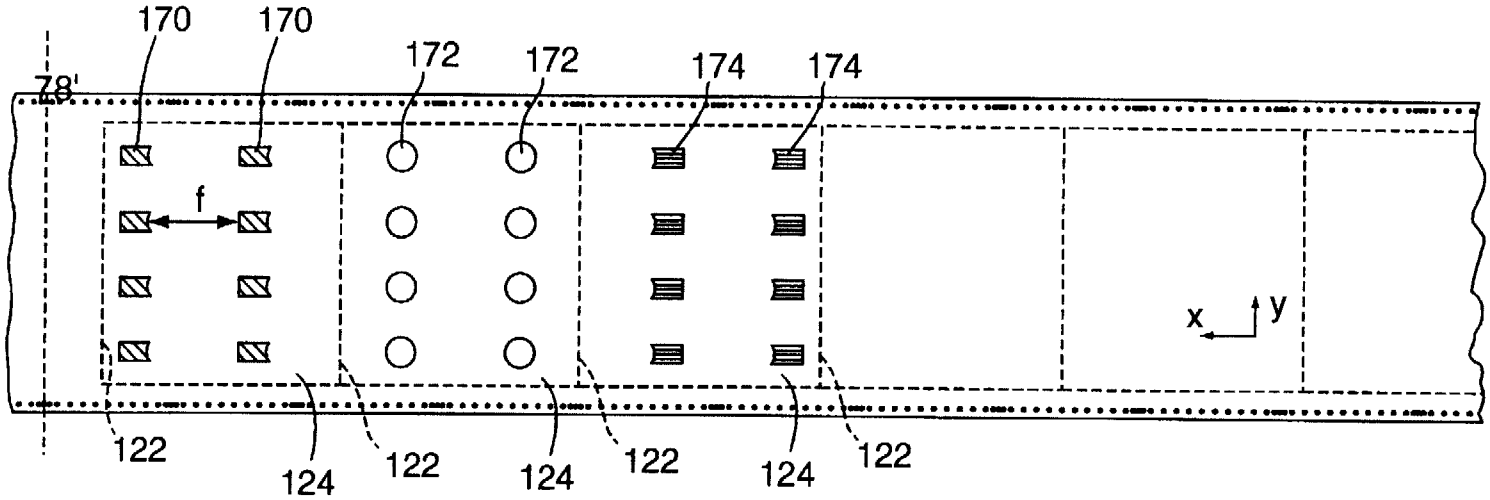
FIG. 9 is a view of the web material of FIG. 7 but illustrating the various portions of the end graphics which are printed by separate ones of the three printers of the FIG. 1 apparatus.

Since each buffer contains up to 3,600 lines of data, and since the lines of information are printed onto the web material at a density of 300 lines per inch, the line data stored in a filled buffer is sufficient for printing up to a 12 inch length of the web material 12, and this variable page dimension is used to imaginarily divide the web 12 into pages or sections following one another in abutting relationship along the length of the web. In FIGS. 7 and 9, the lines dividing the imaginary pages from one another on the web, and which coincide with buffer transitioning, are shown at 122. These pages provide a convenient place to break the printing operation so as to avoid defects in the printed graphics.

As previously mentioned, the line 102 of printing elements 100 of each print head 98 is 11.84 inches long and is comprised of 3,552 printing elements. However, for the printing of information onto the web material 12, slightly less than all of these printing elements are used. Referring to FIG. 4, starting from a standard condition, which is illustrated in FIG. 4, the ones of the printing elements 100 which are used for printing are the ones contained within the distance W, with this distance in the instant case being 11.8 inches and comprising 3,540 printing elements. Twelve of the available printing elements are not used and these are divided into two groups of six located at opposite ends of the distance W to occupy respectively the distances N at each of the opposite ends of the distance W. Therefore, the area of the web material 12 capable of being printed onto by a printer is divided into successive rectangular print frames 124 defined by two adjacent page division lines 122 and two lateral side lines 126 defined by the extent, in the Y coordinate direction, of the used ones of the heating elements 100, meaning that the two lines 126, 126 in FIG. 7 are spaced apart from one another by the same distance W as shown in FIG. 4.

Returning to the introduction of the web material into the apparatus 10 at the start of a job, after the leading portion of the web material has been placed into the first printer 14 as described above, the printer 14 is operated to print its portions of the end graphics onto a sufficient number of the page print frames 124 of the web material as to allow the web material to be threaded through the following accumulator 30 and to reach to the printing station of the printer 16. The same indicator openings 78' as used when placing the web material onto the sprocket wheels of the first printer 14 are then moved onto the indicator sprocket pins 76' of the printer 16. The print head 98 and donor sheet 104 of the printer 16 are then moved to their lowered active position and by suitable command from the command station, the second printer is placed in operation. The instructions provided to the printer 16 cause it to first move the web material the preliminary amount S in the X direction before enabling the printing which enablement occurs at the first page line 122 defining the start of the first one of the page print frame 122. After some printing has been accomplished by the second printer 16, the images printed by both the first printer 14 and the second printer 16 can be inspected to determine how well they register with one another in both the X and Y coordinate directions. If registration errors are detected, they can be corrected by means of the control station 32 by the entry of suitable adjustment instructions. To adjust for a registration error in the X coordinate direction, the operator can instruct the addition or subtraction of a given correction value to the X coordinate components of the image data supplied to the second printer 16 which in effect shifts the page print frames printed by the printer 16 in one direction or the other along the X coordinate axis to bring those print frames into better registration with the print frames of the first printer 14.

To correct for registration errors in the Y coordinate direction appropriate instructions are supplied to the computer 34 at the work station 32 which results in a correction factor being added or subtracted to the Y components of the image data supplied to the printer 16 which will shift the page print frames of the printer 16 in the Y coordinate direction relative to the base of the printer by shifting the group W of used printing elements, as shown in FIG. 4, in one direction or the other along the Y direction by adding printing elements to the group W from the unused group N at one end of the starting group W and by subtracting an equal number of used printing elements from the opposite end of the starting group W and adding them to the adjacent group N.

The introduction of the leading portion of the web material 12 to the third printer 18 then takes place in the same way as described above for the second printer 16, and again after such introduction if any registration errors exist in the images printed by the third printer with respect to the images printed by the first and second printers suitable correcting adjustments can be made in both the X and Y coordinate directions to the printing frames of the third printer through entry of adjustment factors at the control station 32.

Then, after sufficient printed web material has issued from the third printer 38, the leading portion of the web material is threaded through the last one of the three accumulators 30 and moved into the cutting mechanism 20 for cutting of the graphics from the web material. Preferably, the cutting mechanism 20 has feed sprocket wheels 64 similar to the sprocket wheels 64 of the three printers so that registration of the cuts made by the cutting mechanism with the end graphics produced by the three printers takes place in substantially the same way as it does in registering the images printed by the three printers with one another.

Figure 6:
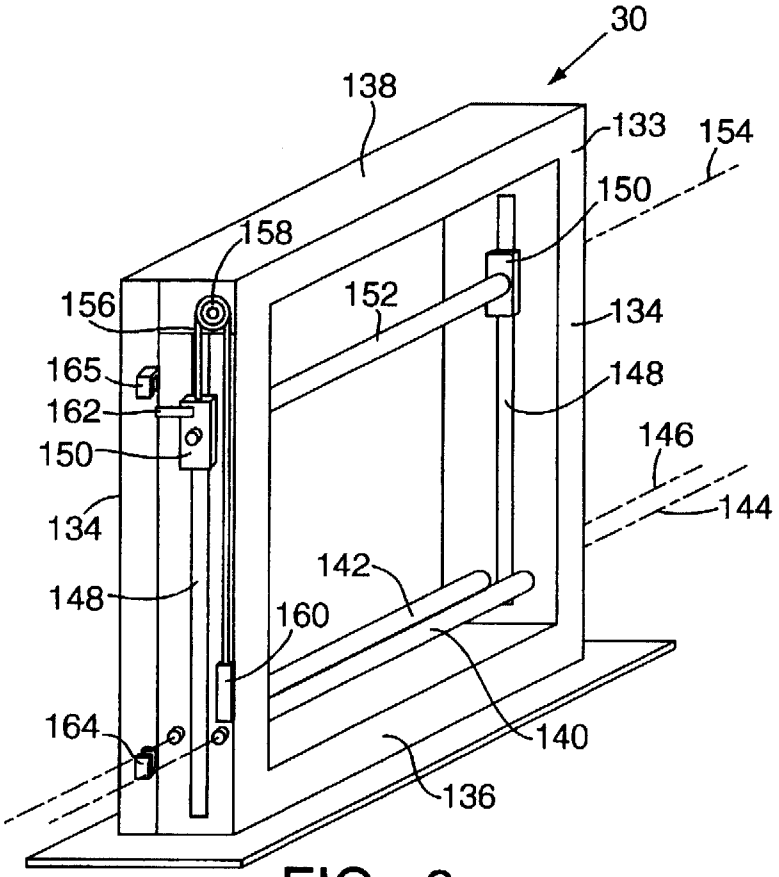
FIG. 6 is a perspective view of one of the accumulator mechanisms of the FIG. 1 apparatus.

All of the three accumulators 30 used in the apparatus 10 are of similar construction, and FIG. 6 shows such construction in greater detail. Referring to this figure, the illustrated accumulator 30 includes a rectangular box-like frame 132 having two vertical legs 134, a lower leg 136 and an upper leg 138. At their lower ends, the two vertical legs 30 support two guide rollers 140 and 142 for rotation about horizontal axes 144 and 146 fixed relative to the vertical legs 134. Each vertical leg has a vertically extending guide slot 148 slidably receiving a guide block 150, and the two guide blocks support a third guide roller 152 for rotation about an axis 154 which is fixed to the guide blocks 150 making the roller 152 movable in the vertical direction with the guide blocks 150. As shown for the left one of the two guide blocks in FIG. 6, each guide block at this upper end is connected with a cable 156 trained over a pulley 158 and connected at its other end to a biasing weight 160. The two biasing weights 160 overbalance the combined weight of the roller 152 and the two slide blocks 150 so that the guide roll 152 is biased to its uppermost position by the two weights 160.

As evident from FIG. 2 in the threading of the web material into and through each of the accumulators, the web material first passes under the roller 152, then upwardly and over the upper roller 152 and then back down to and under the roller 142. Because of the vertical movability of the roller 152 and its being biased upwardly, the accumulator can accumulate a varying amount of slack web material.

Each accumulator 30 further includes a means for detecting the amount of slack material accumulated in it. As shown in FIG. 6, this detecting means includes a vane attached to the left guide block 150 as seen in FIG. 6 and two associated photo detectors 164 and 165. When the pulley 152 moves to near its uppermost position, the vane 162 enters the photo detector 165 and creates a signal from the photo detector 165 indicating the detection of a given maximum amount of accumulated material in the accumulator. Similarly, when the vane 162 reaches and enters the lower detector 164, a signal is produced by that detector 164 indicating the detection of a given minimum amount of accumulated web material in the accumulator. The signal produced by the detectors 164 and 165 are in turn transmitted to the processor 34 through the cable 46 for use in controlling the operation of the printers and of the cutting mechanism 20 as described hereinafter.

Returning to FIG. 7, the end graphics 116 shown therein are ones, as mentioned, having differently colored portions with the portions of one color being printed by one of the printers and with portions of other colors being printed by other separate ones of the printers. In particular, each graphic 116 is made up of three components comprising a black rectangle 170, a red circle 172 and a yellow rectangle 174. FIG. 9, by way of illustration on three successive ones of the illustrated page print frames 124 shows the images printed on a print frame by each one of the printers without showing the portions printed by the other printers. That is, the leftmost page print frame 124 shows the image printed onto a print frame by the black printing printer 14, the next print frame to the right shows the images printed onto a print frame by the red printing printer 16 and the next print frame to the right shows the image printed onto the page frame by the yellow printing printer 18. From these views, it can be seen that for each of the images of different color illustrated in FIG. 9 there are regions extending substantial distances in the X coordinate direction, such as the region indicated at f in which no printing by the associated printer is required.

To conserve donor foil and to speed up the overall printing process, it is desirable that when such substantial regions of no required printing pass the printing head, the printing head and donor foil be lifted from the web material 12, the movement of the donor foil be stopped, and the web material be moved at a faster rate until reaching the end of the region, at which time the print head and the donor foil can be brought back to printing engagement with the web material and the web material movement returned to a slower rate. For example, during movement of the web material past the print head throughout a region in which printing is required, the web material may be moved at a speed of one-third inch per second and when a region requiring no printing moves past the print head and the print head and donor foil are lifted from the web material, the web material may be moved at a speed of two inches per second. Thus, depending on the character of the different images printed on a page frame by each of the printers, the printers may individually require significantly different amounts of time to complete their work on a given print frame. Accordingly, a situation may occur wherein an upstream printer is unable to supply web material fast enough to keep up with demands of the next downstream printer, or the downstream printer may not be able to consume the web material fast enough to keep up with the output of the upstream printer. The accumulators arranged between the work units alleviate this problem by accumulating a variable amount of slack web material and smoothing out momentary differences feed rates. Further, when the material accumulated by an accumulator reaches a given maximum amount, the signal produced by the detector 165 is used by the computer 34 to temporarily stop the operation of the immediately upstream printer until the immediately downstream printer consumes enough of the accumulated material to bring the quantity of the accumulated material back to an acceptable value. If the material accumulated in the accumulator reaches a minimum value, the signal produced by the detector 164 is used by the computer 34 to temporarily stop the operation of the immediately downstream printer until such time as the accumulated material rises again to an acceptable value.

In FIG. 7, it will be noted that the arrangement of the end graphics 116 printed onto the web material 12 is such that the arrangement of the end graphics is the same for all of the print frames 124. When this is the case, the apparatus can be operated in what is referred to as the "hardware mode" which means that the computer 34 in the initiation of the printing by each of the printers sends each printer the image data needed to print onto one print frame and then also instructs the printer to repeat such printing for a given number of print frames making up the entire job.

Figure 10:
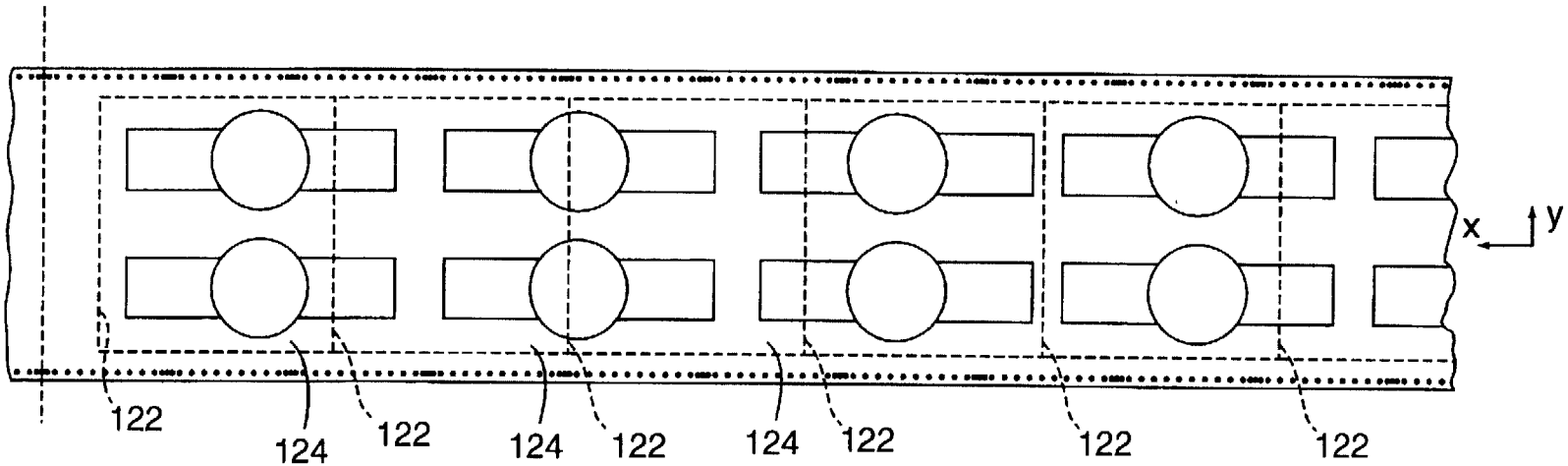
FIG. 10 is a view similar to FIG. 7 but showing the web material printed with another example of end graphics.

It may not, however, be possible or efficient to always arrange the graphics so as to be printed in the way illustrated in FIG. 7 and then the graphics may be printed as shown in FIG. 10 wherein, although the printed end graphics may repeat at given intervals along the length of the web material, the repeats do not coincide with the print frames 124 so that the image printed on one print frame is different from the images printed on others of the print frame. When this is the case, the apparatus is operated in what is referred to as the "software mode", which means that the computer 34 provides each of the printers with image data for each of the print frames to be printed by that printer.

We claim:

1. An apparatus for working on a length of web material, said apparatus comprising:

a plurality of separate units for individually working on a length of web material, each of said units having a means defining a work station, and a feed mechanism for feeding said length of web material longitudinally of itself past said work station in an X coordinate direction, said units being arranged in serial relationship to one another along said X coordinate direction with said web material during operation of said apparatus passing serially through said units, a controller providing each of said units with data for operating said unit to cause said unit to perform a desired work function on said web material and to cause each of said units to consume a given amount of time in feeding a given length of said web material through said unit which amount of time may be different for different ones of said units, an accumulator mechanism arranged between at least one pair of successive ones of said serially arranged units which accumulator mechanism is arranged along said X coordinate direction and operates to accumulate a variable lengthwise slack amount of said web material after it has issued from the one of said units located immediately upstream of said accumulator mechanism and before being received by the one of said units located immediately downstream of said accumulator mechanism, said accumulator mechanism including a detector means for directly sensing the amount of slack material accumulated by said accumulator mechanism and operable to produce output signals indicating the presence in said accumulator mechanism of different amounts of slack material, and a means responsive to said output signals of said detector means for controlling the operation of at least one of said immediately upstream unit and said immediately downstream unit.

2. An apparatus as defined in claim 1, wherein:

said detector means is operable to produce a given output signal when the sensed amount of slack material in said accumulator mechanism falls below a pre-given minimum value, and said controller includes a means for inhibiting the feeding of said web material in said X coordinate direction by said immediately downstream one of said units in response to the appearance of said given signal.

3. An apparatus as defined in claim 1, wherein:

said detector means is operable to produce a given output signal when the sensed amount of slack material in said accumulator mechanism exceeds a pre-given maximum value, and said controller includes a means inhibiting the feeding of said web material in said X coordinate direction by said immediately upstream one of said units in response to the appearance of said given signal.

4. An apparatus as defined in claim 1 wherein at least one of said units is a unit selected from the class consisting of thermal printers, ink jet printers, and X-Y cutters.

5. An apparatus as defined in claim 1, wherein:

a plurality of said units are printers for printing onto said web material to produce end graphics on said web material, each of said printers printing a separate portion of said end graphics.

6. An apparatus as defined in claim 5, wherein:

said end graphics are multi-colored, and each of said printers prints a differently colored portion of said end graphics onto said web material.

7. A method for working on a length of web material, said method comprising:

providing a plurality of separate units for individually working on a length of sheet material with each of said units having a means defining a work station and a feed mechanism for feeding said length of web material longitudinally of itself past said work station in an X coordinate direction, arranging said units in serial relationship to one another along said X coordinate direction, training said web material to move lengthwise of itself along said X coordinate direction and to pass serially through said units, providing each of said units with data for causing said unit to perform a desired work function on said web material and to cause each of said units to consume a given amount of time in feeding a given length of said web material through said unit which given amount of time may be different for different ones of said units, accumulating in an accumulator mechanism a variable amount of slack material between at least one adjacent pair of said units, directly sensing the amount of slack material accumulated in said accumulator mechanism to produce a first signal when said amount of accumulated slack material exceeds a first pre-given value and a second signal when said amount of accumulated slack material falls below a second pre-given amount, and controlling the operation of at least one unit of said adjacent pair of units in response to at least one of said first and second signals.

8. The method defined in claim 7, wherein:

said step of controlling the operation includes stopping the feeding of said web material in said X coordinate direction by the immediately downstream one of said adjacent pair of units in response to the appearance of said second signal.

9. The method defined in claim 7, wherein:

said step of controlling the operation includes stopping the feeding of said web material in said X coordinate direction by the immediately upstream one unit of said adjacent pair of units in response to the appearance of said first signal.

10. A thermal printing apparatus for generating graphics on a length of receiving web material which includes at least one marginal edge portion extending along the length of the receiving web material and provided with sprocket holes spaced from one another along said length of the receiving web material, which apparatus uses a number of printers and an equal number of donor foils each carrying a thermally releasable printing agent so that said apparatus is capable of generating end graphics made up of separate portions printed by separate ones of said printers, said apparatus comprising:

a plurality of thermal printers, each of said thermal printers having a thermal print head with a plurality of printing elements arranged in a row extending in a Y coordinate direction, a feed mechanism for feeding said length of receiving web material longitudinally of itself past said print head in an X coordinate direction extending perpendicularly to said Y coordinate direction, a means for receiving a respective one of said donor foils, and a means for feeding said received donor foil past said thermal print head in superimposed relation to said receiving web material so that energizations of said printing elements cause transfers of spots of said printing agent from said donor foil to said receiving web material, said thermal printers being arranged in serial relationship to one another along said X coordinate direction with said receiving web material during operation of said apparatus passing serially and unidirectionally through said printers, and a controller providing each of said printers with image data for operating its print head and its feed mechanism so as to print onto said receiving web material separate portions of the end graphics, said feed mechanism of each of said thermal printers including at least one sprocket wheel with sprocket pins engagable with said sprocket holes of a respective one of said marginal edge portions of said receiving web material for positioning said receiving web material in both said X and said Y coordinate directions relative to said print head of that thermal printer.

11. A thermal printing apparatus as defined in claim 10 wherein:

each of said feed mechanisms of said thermal printers includes at least one sprocket wheel with sprocket pins engagable with said sprocket holes of a respective one of said marginal edge portions of the receiving web material for positioning said receiving web material in both said X and said Y coordinate directions relative to said print head of the associated thermal printer, said cutting mechanism includes a base frame immovable in said X and Y coordinate directions and relative to which said knife is movable in at least said Y coordinate direction, and said cutting mechanism means also includes at least one sprocket wheel with sprocket pins engagable with said sprocket holes of a respective one of said marginal edge portions of the receiving web material for positioning said base frame of said cutting mechanism and said receiving web material relative to one another in both said X and said Y coordinate directions.

12. A thermal printing apparatus for generating graphics on a length of receiving web material and which apparatus uses a number of printers and an equal number of donor foils each carrying a thermally releasable printing agent so that said apparatus is capable of generating end graphics made up of separate portions printed by separate ones of said printers, said apparatus comprising:

a plurality of thermal printers, each of said thermal printers having a thermal print head with a plurality of printing elements arranged in a row extending in a Y coordinate direction, a feed mechanism for feeding said length of receiving web material longitudinally of itself past said print head in an X coordinate direction extending perpendicularly to said Y coordinate direction, a means for receiving a respective one of said donor foils, and a means for feeding said received donor foil past said thermal print head in superimposed relation to said receiving web material so that energizations of said printing elements cause transfers of spots of said printing agent from said donor foil to said receiving web material, said thermal printers being arranged in serial relationship to one another along said X coordinate direction with said receiving web material during operation of said apparatus passing serially and unidirectionally through said printers, and a controller providing each of said printers with image data for operating its print head and its feed mechanism so as to print onto said receiving web material separate portions of the end graphics, a cutter mechanism located downstream, with respect to the direction of movement of said receiving web material through said plurality of thermal printers, of the most downstream one of said thermal printers so as to receive said receiving web material after it leaves said most downstream thermal printer, said cutting mechanism including a knife and a means for moving said knife and said receiving web material relative to one another in said X and Y coordinate directions to cut said end graphics from said receiving web material, and said controller including means for providing said cutting mechanism with cutting data for operating said cutting mechanism to cause said knife to cut said end graphics from said receiving web material.

13. A thermal printing apparatus as defined in claim 12, wherein said printers and said cutting mechanism may take different amounts of time to perform the printing and cutting required by each of said printers and said cutting mechanism on a given length of said web material, and wherein said apparatus further comprises:

an accumulator mechanism arranged between each pair of successive ones of said serially arranged thermal printers and arranged along said X coordinate direction so as to accumulate a variable lengthwise slack amount of said receiving web material after it has issued from the one of said printers located upstream of said accumulator mechanism and before being received by the one of said printers located immediately downstream of said accumulator mechanism, and an accumulator mechanism located between the most downstream one of said serially arranged thermal printers and said cutting mechanism and located on said X coordinate direction so as to accumulate a variable lengthwise slack amount of said receiving web material after it has issued from said most downstream one of said serially arranged printers and before it is received by said cutting mechanism.

14. A thermal printing apparatus for generating graphics on a length of receiving web material which carries a plurality of longitudinal position indicators spaced uniformly from one another along the length of said receiving web material, which apparatus uses a number of printers and an equal number of donor foils each carrying a thermally releasable printing agent so that said apparatus is capable of generating end graphics made up of separate portions printed by separate ones of said printers, said apparatus comprising:

a plurality of thermal printers, each of said thermal printers having a thermal print head with a plurality of printing elements arranged in a row extending in a Y coordinate direction, a feed mechanism for feeding said length of receiving web material longitudinally of itself past said print head in an X coordinate direction extending perpendicularly to said Y coordinate direction, a means for receiving a respective one of said donor foils, and a means for feeding said received donor foil past said thermal print head in superimposed relation to said receiving web material so that energizations of said printing elements cause transfers of spots of said printing agent from said donor foil to said receiving web material, said thermal printers being arranged in serial relationship to one another along said X coordinate direction with said receiving web material during operation of said apparatus passing serially and unidirectionally through said printers, a controller providing each of said printers with image data for operating its print head and its feed mechanism so as to print onto said receiving web material separate portions of the end graphics, said controller supplying said image data to said thermal printers in page data blocks each of which page data blocks contains image data for causing the associated one of said thermal printers to print on said receiving web material within the bounds of a rectangular page field having lateral sides parallel to said X coordinate direction and leading and trailing sides parallel to said Y coordinate direction, the page fields corresponding to said page data blocks being part of a job run having a given number of page fields and being arranged in abutting succession to one another along the length of said receiving web material, and means associated with each of said printers for positioning the leading edge of the first print field of said job run relative to said receiving web material at a position along said X coordinate axis related to the position along said X coordinate axis of a given one of said longitudinal position indicators of the receiving web material.

15. A thermal printing apparatus as defined in claim 14, for use with a receiving web material wherein said longitudinal position indicators are indicator ones of said sprocket holes in at least one of said marginal edge portions of said web material, wherein:

each of said printers has a base frame immovable in said X and Y coordinate directions, said at least one sprocket wheel of each of said printers is rotatable on an axis fixed to said base frame of that printer and extending in the Y coordinate direction, and said means of each printer for positioning said leading edge of said first print field relative to said receiving web material includes one indicator sprocket pin on said at least one sprocket wheel of that printer which indicator sprocket pin enters said indicator sprocket holes as said receiving web material is moved through the printer, and means for positioning said leading edge of said first print field relative to said web material a given distance in said X coordinate direction away from a selected one of said indicator holes.

16. A thermal printing apparatus as defined in claim 14 further comprising:

means associated with at least one of said thermal printers for finely adjusting in said X coordinate direction and relative to said receiving web material the positions of the print fields printed by that printer to allow correction of errors which may appear in the registration in the X coordinate direction of the print fields printed by that printer with the print fields printed by another one of said printers.

17. A thermal printing apparatus as defined in claim 14 further comprising:

means associated with at least one of said thermal printers for finely adjusting in said Y coordinate direction and relative to said receiving web material the positions of the print fields printed by that printer to allow correction of errors which may appear in the registration in the Y coordinate direction of the print fields printed by that printer with the print fields printed by another one of said printers.

18. A thermal printing apparatus as defined in claim 16, wherein:

said means for finely adjusting the positions of said print fields in said X coordinate direction comprises a means for adding or subtracting a correction factor to the X coordinate components of said image data.

19. A thermal printing apparatus as defined in claim 17, wherein:

said means for finely adjusting said print fields in said Y coordinate direction comprises said thermal print head of the involved printer having a thermal print head with a row of printing elements longer than the width of said printing fields in said Y coordinate direction so that the printing elements of the print head consist of a fundamental group located along a portion of the length of the row which portion is equal in length to the width of the print fields and two sets of supplemental printing elements located respectively at opposite ends of said row portion, and means for shifting the printing elements making up the fundamental group laterally in the Y coordinate direction so as to use more and less of the supplemental printing elements at the opposite ends, respectively, of said row portion and to thereby shift the print field printed by that print head in the Y coordinate direction relative to the receiving web material.

20. A thermal printing apparatus for generating graphics on a length of receiving web material and which apparatus uses a number of printers and an equal number of donor foils each carrying a thermally releasable printing agent so that said apparatus is capable of generating end graphics made up of separate portions printed by separate ones of said printers, said apparatus comprising:

a plurality of thermal printers, each of said thermal printers having a thermal print head with a plurality of printing elements arranged in a row extending in a Y coordinate direction, a feed mechanism for feeding said length of receiving web material longitudinally of itself past said print head in an X coordinate direction extending perpendicularly to said Y coordinate direction, a means for receiving a respective one of said donor foils, and a means for feeding said received donor foil past said thermal print head in superimposed relation to said receiving web material so that energizations of said printing elements cause transfers of spots of said printing agent from said donor foil to said receiving web material, said thermal printers being arranged in serial relationship to one another along said X coordinate direction with said receiving web material during operation of said apparatus passing serially and unidirectionally through said printers.

a controller providing each of said printers with image data for operating its print head and its feed mechanism so as to print onto said receiving web material separate portions of the end graphics, said printers in comparison with one another being ones which may take different amounts of time to perform the printing required by each of said printers onto a given length of said web material, and an accumulator mechanism arranged between each pair of successive ones of said serially arranged thermal printers which accumulator mechanism is arranged along said X coordinate direction and operates to accumulate a variable lengthwise slack amount of said receiving web material after it has issued from the one of said printers located immediately upstream of said accumulator mechanism and before being received by the one of said printers located immediately downstream of said accumulator mechanism.

21. A thermal printing apparatus as defined in claim 20, wherein:

a means is associated with each of said accumulator mechanisms to stop the one of said thermal printers located immediately downstream from said accumulator mechanism from feeding said web material in said X coordinate direction when the slack amount of said receiving web material accumulated by that accumulator mechanism is less than a predetermined minimum amount.

22. A thermal printing apparatus as defined in claim 20, wherein:

a means is associated with each of said accumulator mechanisms to stop the one of said printers located immediately upstream of that accumulator mechanism from feeding said web material in said X coordinate direction when the slack amount of said receiving web material accumulated by said accumulator mechanism exceeds a pre-determined maximum amount.

23. A thermal printing apparatus as defined in claim 20, wherein:

a means is associated with each of said accumulator mechanisms to stop the one of said thermal printers located immediately downstream from said accumulator mechanism from feeding said web material in said X coordinate direction when the slack amount of said receiving web material accumulated by that accumulator mechanism is less than a pre-determined minimum amount, and a means is associated with each of said accumulator mechanisms to stop the one of said printers located immediately upstream of that accumulator mechanism from feeding said web material in said X coordinate direction when the slack amount of said receiving web material accumulated by said accumulator mechanism exceeds a pre-determined maximum amount.

24. A thermal printing method for generating end graphics on a length of receiving web material, said method comprising:

providing a plurality of thermal printers, arranging said printers in serially spaced relationship along an X coordinate direction, providing a plurality of donor foils each carrying a thermally releasable printing agent, supplying each of said plurality of donor foils to a respective one of said thermal printers, each of said thermal printers being operable to move a receiving web material through that printer in said X coordinate direction and to print onto said receiving web material separate portions of end graphics using the one of said donor foils supplied to that printer.

providing a receiving web material and introducing it to said printers so as to be moved by said printers longitudinally of itself in said X coordinate direction through successive ones of said printers.

supplying each of said printers with image data for causing that printer to print separate portions of end graphics onto said receiving web material so that said web material when it issues from the most downstream one of said serially arranged thermal printers contains end graphics made up of the various separate portions printed by the separate ones of said serially arranged printers.

providing a cutting mechanism.

arranging said cutting mechanism to follow in said X coordinate direction the most downstream one of said thermal printers.

introducing said receiving web material to said cutting mechanism after it has issued from said most downstream one of said thermal printers, and operating said cutting mechanism to cut said end graphics from said receiving web material.

25. A thermal printing method for generating end graphics on a length of receiving web material, said method comprising:

providing a plurality of thermal printers.

arranging said printers in serially spaced relationship along an X coordinate direction.

providing a plurality of donor foils each carrying a thermally releasable printing agent.

supplying each of said plurality of donor foils to a respective one of said thermal printers.

each of said thermal printers being operable to move a receiving web material through that printer in said X coordinate direction and to print onto said receiving web material separate portions of end graphics using the one of said donor foils supplied to that printer.

providing a receiving web material and introducing it to said printers so as to be moved by said printers longitudinally of itself in said X coordinate direction through successive ones of said printers.

supplying each of said printers with image data for causing that printer to print separate portions of end graphics onto said receiving web material so that said web material when it issues from the most downstream one of said serially arranged thermal printers contains end graphics made up of the various separate portions printed by the separate ones of said serially arranged printers.

operating said thermal printers so that given uniform lengthwise sections, in said X coordinate direction, of said receiving web material may be fed through said printers in amounts of time different for different ones of said printers.

providing an accumulator mechanism between each pair of adjacent ones of said serially arranged thermal printers and passing said receiving web material through said accumulator mechanism so that it accumulates a variable slack amount of said receiving web material after it issues from the immediately upstream one of said thermal printers and before it is received by the immediately downstream one of said thermal printers, and controlling the operation of at least one of said immediately upstream printer and said immediately downstream printer in response to the amount of slack material accumulated by said accumulator mechanism.

26. A thermal printing method as defined in claim 25, wherein:

said step of controlling includes inhibiting the printing onto said web material and the feeding of said web material in said X coordinate direction by said immediately downstream one of said printers in response to the slack amount of said web material accumulated by said accumulator mechanism falling below a predetermined value.

27. A thermal printing method as defined in claim 25, wherein:

said step of controlling includes inhibiting the printing onto said web material and the feeding of said web material in said X coordinate direction by said immediately upstream one of said printers in response to the slack amount of receiving web material accumulated by said accumulator mechanism exceeding a predetermined value.

* * * * *